US008529248B2

(12) United States Patent
Clement

(10) Patent No.: US 8,529,248 B2
(45) Date of Patent: Sep. 10, 2013

(54) BURNER/HOT AIR GENERATOR APPARATUS OF THE EXTENDER TYPE

(75) Inventor: Francois Clement, Le Haillan (FR)

(73) Assignee: Sefmat, Le Haillan Cedex (FR)

( * ) Notice: Subject to any disclaimer, the term of this patent is extended or adjusted under 35 U.S.C. 154(b) by 291 days.

(21) Appl. No.: 12/447,954

(22) PCT Filed: Oct. 30, 2007

(86) PCT No.: PCT/FR2007/001792

§ 371 (c)(1),
(2), (4) Date: Apr. 30, 2009

(87) PCT Pub. No.: WO2008/059133

PCT Pub. Date: May 22, 2008

(65) Prior Publication Data

US 2010/0075266 A1 Mar. 25, 2010

(30) Foreign Application Priority Data

Oct. 31, 2006 (FR) ..... 06 09565

(51) Int. Cl.
*F23D 14/46* (2006.01)
*F23D 11/36* (2006.01)
*A01M 15/00* (2006.01)

(52) U.S. Cl.
USPC ..... 431/345; 431/343; 43/144

(58) Field of Classification Search
USPC ..... 431/343, 345; 43/144
See application file for complete search history.

(56) References Cited

U.S. PATENT DOCUMENTS

| | | | | |
|---|---|---|---|---|
| 712,843 | A * | 11/1902 | Paul | 173/30 |
| 3,781,991 | A | 1/1974 | Stretton et al. | |
| 3,926,544 | A | 12/1975 | Thorpe | |
| 6,010,329 | A | 1/2000 | Zagoroff | |
| 6,105,206 | A * | 8/2000 | Tokumaru et al. | 15/344 |
| 6,227,846 | B1 * | 5/2001 | Zagoroff | 431/345 |
| 6,257,875 | B1 * | 7/2001 | Johnstone et al. | 431/345 |
| 6,474,053 | B1 * | 11/2002 | Lund | 56/13.7 |
| 2004/0231166 | A1 | 11/2004 | Wilkinson | |
| 2005/0003317 | A1 * | 1/2005 | Mizuno et al. | 431/345 |
| 2005/0115086 | A1 * | 6/2005 | Wilkey | 30/517 |
| 2008/0092398 | A1 * | 4/2008 | Hurley et al. | 30/276 |

FOREIGN PATENT DOCUMENTS

| | | | |
|---|---|---|---|
| DE | 8533624 | U1 | 1/1986 |
| FR | 2764969 | A1 | 12/1998 |
| GB | 777486 | A | 6/1957 |

* cited by examiner

*Primary Examiner* — Kenneth Rinehart
*Assistant Examiner* — William Corboy
(74) *Attorney, Agent, or Firm* — Browdy and Neimark, PLLC

(57) ABSTRACT

The invention relates to an apparatus comprising an injection device (1) for producing a flow of a high-speed combustible gas mixture, and a burner head (2) in which said flow is injected through a tabular extender (70) connecting said injection device (1) to said head (2). The extender has a maximal length higher than 600 mm and includes at the gravity center of the device assembly, means for suspension to a portion of the operator's body.

9 Claims, 9 Drawing Sheets

BURNER/HOT AIR GENERATOR APPARATUS OF THE EXTENDER TYPE

BACKGROUND OF THE INVENTION

1. Field of the Invention

The present invention relates to a hot air generator/burner apparatus with an extender which may notably but not exclusively be used for low temperature heating of a plastic film, for example a polyethylene film, with a view to their retraction by means of a gas flow stemming from the combustion of a combustible gas such as propane and air or for laying a thermoplastic material on the ground.

2. Description of the Prior Art

In order to satisfy this type of application, the burner should therefore be designed in order to produce a gas flow having a temperature of 120°-540° C. at a predetermined distance from the burner (a distance at which the material to be treated should be positioned).

At this distance, the temperature must be relatively homogeneous and the gas flow free of combustion material, if the intention is to avoid any possibility of burning, scorching and blistering of the material.

In order to achieve this result, a burner has already been proposed, particularly in the U.S. Pat. No. 6,010,329, comprising an injection device capable of producing a high velocity flow of combustible gas mixture and of injecting this flow into a burner head with a tubular shape successively including:

- a pressure recovery chamber having, in the plane of symmetry of the head, a divergent shape and inside which the gas mixture stemming from the injection device develops according to a fan configuration,
- an ignition chamber with a substantially constant and rectangular section,
- two deflectors which respectively extend the two major sides of the ignition chamber, and which converge towards each other, both of these deflectors having two rectilinear front borders forming a passage with reduced width between them, and
- diffusion means which may comprise a grating or even a set of two gratings, with a substantially hemi-cylindrical shape, attached to the inside of the head at the junction of both chambers, these diffusion means forming a bulging partition, with an axis parallel to said borders, in said plane of symmetry, and the concavity of which is directed towards the inside of the pressure recovery chamber.

In this burner, the diffusion means may be produced from a grating or a perforated metal sheet.

It is found that by means of the structure described earlier, the burner head is not licked by the flame and therefore does not undergo significant heating.

In order to homogenize the anterior front of the flame and avoid that untimely orientations of the burner induce heterogeneities of the flame, the use of circular shapes for the front borders of the ignition chamber and deflectors as well for the diffusion grating was proposed (Patent Application FR 87 06930).

The invention more particularly relates to a burner of the type of the one described earlier equipped with an extender consisting in a tubular, possibly telescopic, component, which may be inserted between the tubing of the injection device and the head of the burner.

With Patent Application PCT/FR05/02720, the Applicant has already proposed a solution for solving the following problems:

- A first problem resulting from the fact that upon extinguishing the burner, a relatively large volume of gas mixture remains inside the assembly formed by the head of the burner, the extender and the injection tubing. Now, upon stopping the burner, the flow rate of the gas mixture, notably through the diffusion grating, is lowered before becoming zero. Therefore, below a certain flow rate, diffusion means, the perforations of which have been determined so as to obtain in the ignition chamber a large gas flow at a relatively high velocity, no longer retain the flame. This is the reason why the combustion propagates inside the aforesaid assembly by generating a slight explosion. This explosion which is not devoid of any risk has especially the drawback of being noisy, and consequently difficult to accept in a factory or on a building site.
- A second problem resulting from the fact that the extender is made in an electrically conducting material and is connected to the ground of the electric (piezoelectric) generator. Therefore, the conductor which passes in the extender in order to connect the output of the electric generator to the ignition electrode positioned in the ignition chamber, forms with said extender a capacitor, the capacitance of which depends on the length of the extender and on the positioning of the conductor inside said extender. This capacitor has the drawback of absorbing a significant fraction of the electric charge delivered by the electric generator upon ignition. The charge applied to the ignition electrode is therefore lowered.
- A third problem results from the fact that the gases propelled to a high velocity by the injection tubing do not mix homogeneously inside the extender. This heterogeneity is itself dependent on the length of the extender. The use of deflectors intended to generate perturbations in the gas flow in order to improve its homogeneity however has the drawback of slowing down the flow which is contrary to the sought effect in a high velocity burner.

Nevertheless, the conducted tests have shown problems concerning how these burners are used, taking into account their great length and the distribution of their masses.

Thus, notably for carrying out applications of hot-melt materials at ground level, first of all pistols equipped with a straight extender not exceeding 600 mm were suggested, vertically held at arm's length, the burner being held at a determined distance from the ground, for example at 5 cm from the ground.

It is found that this solution has the following drawbacks:

- The operator is forced to hold the burner at arm's length in order to move the heat source away from his/her feet, whence tiredness (the duration of use may amount to 50% of the work duration).
- It is impossible to work in an area away from the operator.
- When the device is stopped, the operator has to hold the handle very tightly in order to maintain it, otherwise, he/she risks performing an action on the trigger for opening the gas flow.
- The length of the extender does not suit all the heights of users and makes the use of the burner even more tiresome.
- The operator is forced to hold the burner with one hand and the gas supply flexible hose with the other hand so that he/she is not in the working area.
- It is very difficult to maintain the head of the burner with its axis perpendicular to the plane of the surface of the object to be treated so that the action of the burner is not homogenous and a risk of burning oneself is incurred.

OBJECT OF THE INVENTION

More particularly the object of the invention is therefore to suppress these drawbacks. For this purpose, it proposes a hot air generator/burner of the aforesaid type in which the extender is elongated and has a maximum length exceeding 600 mm and substantially comprises, at the centre of gravity of the device, means for suspending it on a portion of the body of the operator, such as for example a handle and/or a body harness, which will be attached on the extender.

SUMMARY OF THE INVENTION

With these arrangements, the following advantages may be obtained:

- The position of the suspension means, substantially at the centre of gravity allows the device to be carried with one hand, with a vertical arm, practically without any effort.
- Because the apparatus is supported with one hand, the second hand of the operator is not subject to any particular constraint. It may be assigned to controlling the device (starting/stopping it and sweeping the area to be treated).
- Because of the length of the extender, the distance between the head of the burner (heat source) and the operator is considerably increased. It is therefore possible to work much farther from the operator and over a larger surface without moving.
- Greater ease is obtained for adjusting the distance between the ground and the head of the burner and an adaptation to the height of the users is obtained by modifying the angle of use of the device.

Advantageously, the suspension means may be conformed so as to allow additional adaptation of the device to the height of the operator.

Thus, for example, the aforesaid handle may have an annular shape, the adaptation being obtained by a suitable position of the hand on the handle.

Moreover, the length of the harness may be adjustable.

Also, the axial position of the suspension means of the extender may be adjusted by adjustment means. Of course, because it is not subject to a notable rise in temperature, the extender may be directly held in the hand (for example the hand which is freed by the use of the harness) for example in order to carry out a more accurate treatment.

In the case when the device is intended for performing treatments on the ground, the axis of the burner head preferably with the axis of the extender, will form an angle substantially equal to the angle which the extender forms with the vertical when the device is used by an operator.

Now, it is found that this angle varies because of the morphology of the operator.

Moreover, for certain applications, it is preferable that the axis of the extender extends in the main plane of symmetry of the head of the burner, while for other applications, it is preferable that the orientation of the head of the burner be different.

This is why the invention provides between the extender and the head of the burner a connection with an adjustable orientation, such as for example a ball-joint or Cardan joint connection.

In certain applications, the operator is led to hold the device at arm's length, so as to be able to benefit from the whole of its length. This is notably the case of a use other than a treatment on the ground.

In order to reduce the strain on the operator, during this method of use, the use of a rigid cuff bound to the handle of the device and used for transferring on the forearm the forces which would be normally be exerted at the wrist, was suggested.

Nevertheless, this solution has a certain number of drawbacks. It imposes a not very easy assembly or disassembly and it is a nuisance when the operator uses the device without any extender. Further, it is not adapted to all morphologies.

In order to avoid these drawbacks, the invention proposes the use of an extractable and/or retractable holding device, mounted in the injection device and not on the handle as earlier.

DESCRIPTION OF THE DRAWINGS

Embodiments of the invention will be described hereafter, as non-limiting examples, with reference to the appended drawings wherein.

DESCRIPTION OF THE PREFERRED EMBODIMENTS

Figure 1:
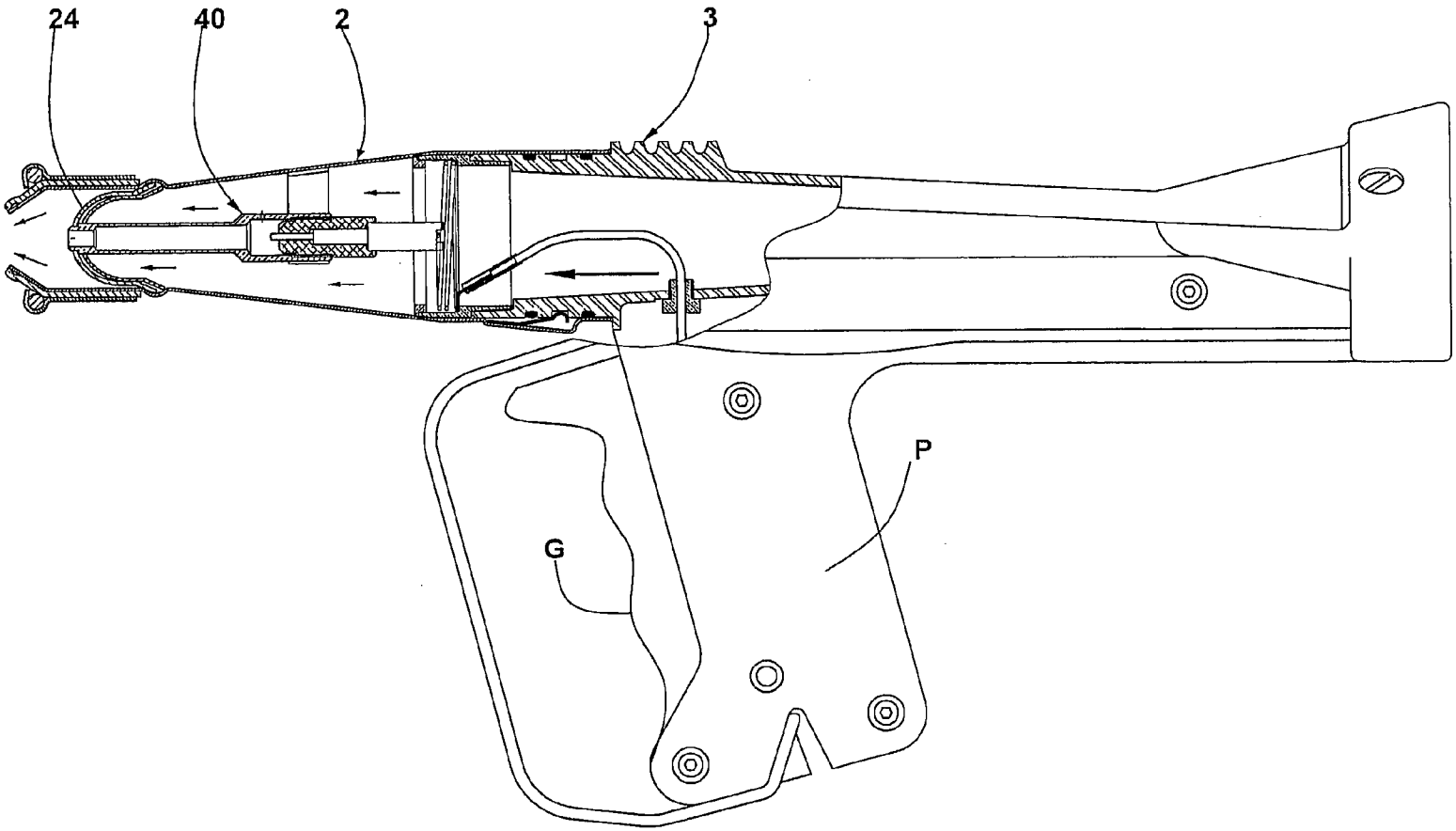
FIG. 1 is a sectional view in a vertical plane of a short high velocity burner of the cold nozzle type.
Figure 2:
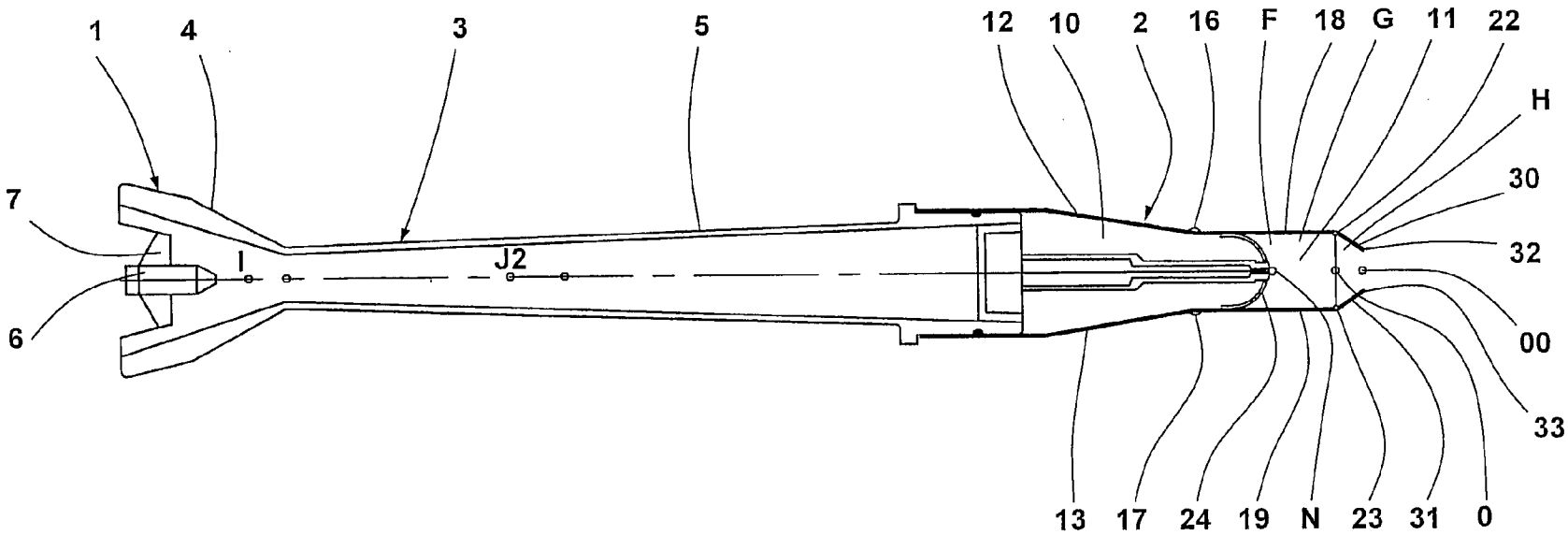
FIG. 2 is a schematic sectional view illustrating the operating principle of the burner illustrated in FIG. 1.
Figure 3:
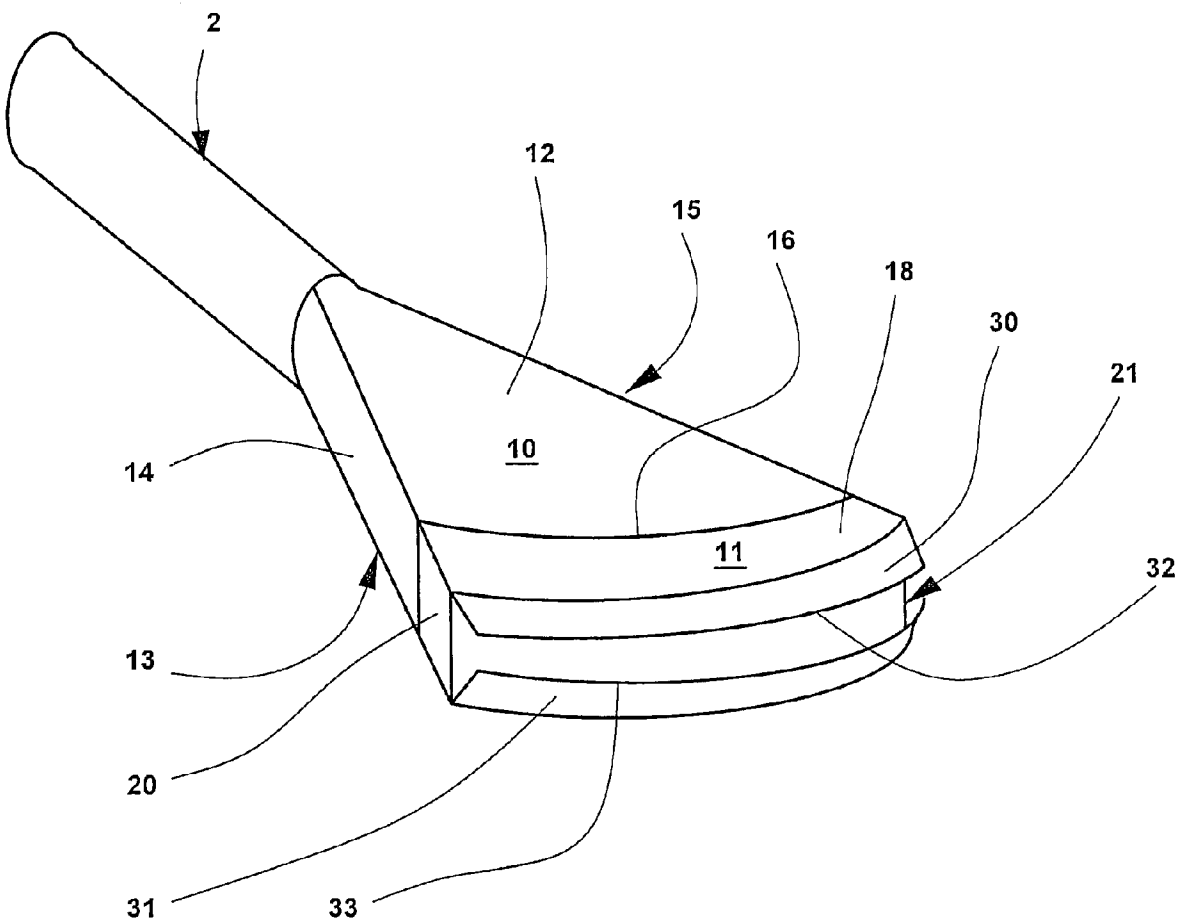
FIG. 3 is a schematic perspective view of the head of the burner.

In the example illustrated in FIGS. 1 to 3, the burner comprises an injection device 1 capable to transmitting to the head of the burner 2, a flow of combustible gas mixture.

This injection device 1 more particularly involves:

- tubing 3 formed in two sections, i.e. a convergent back section 4 and a substantially divergent front section 5,
- an injection nozzle 6 mounted in the convergent section 4, this nozzle 6 being connected to a source of flammable gas having a pressure of the order of 1-4 bars, and
- at least one opening 7 for letting through air, located in the annular area comprised between said nozzle 6 and said section 4.

This device therefore forms a jet pump which drives the air stemming from the opening 7 and generates in the convergent portion 4 of the tubing 3 (point I) a gas mixture flow at high velocity, of the order of 12,660 meters/minute.

The head of the burner 2, with a tubular shape, as for it, consists of two electrically conducting metal portions which successively delimit a pressure recovery chamber 10 which is connected to the tubing and an ignition chamber 11 which opens out in free air.

The pressure recovery chamber 10 beyond its area for connection to the tubing 3 has a flared shape delimited by two convergent walls 12, 13, with increasing width and two divergent sidewalls 14, 15 with decreasing width. As this is visible in FIGS. 2 and 3, the front borders 16, 17 of both convergent walls 12, 13 have coaxial circular shapes.

The ignition chamber 11 has a shape which is also flared. However, in this example, it is delimited by two parallel walls 18, 19 which extend both convergent walls 12, 13 and two divergent sidewalls 20, 21 which extend the sidewalls 14, 15, respectively, according to the same orientation. The front borders 22, 23 of both walls 18, 19 are circular and extend coaxially with the borders 16, 17.

Both of these chambers 10, 11 are separated from each other by a dual diffusion grating 24 which consists in two perforated metal sheet parts having the shape of a toric sector with a substantially hemi-cylindrical section, and the major radius of curvature of which substantially corresponds to that of the front borders 16, 17 of the convergent walls 12, 13. The perforated metal sheet, on the pressure recovery chamber side 10, has a long and narrow oblong cut-out at its centre.

Attachment of this diffusion grating 24 inside the head of the burner 2 is carried out in the junction area of the chambers 10 and 11, the concavity of this grating being oriented towards the pressure recovery chamber 10.

The walls 18 and 19 of the ignition chamber 11 are extended with two deflectors 30, 31 of circular shape which substantially converge towards each other and have two respective coaxial borders 32, 33 forming between them a passage space with a width less than the width of the lateral sides 20, 21 of the ignition chamber 11.

In this example, the burner involves an ignition device including a cylindrical ignition chamber 43 which extends coaxially with the head 2 of the burner inside the pressure recovery chamber 10 via an ignition funnel 44 which passes through the dual perforated grating 24 in its centre and opens out into the ignition chamber 11 while in the other end of the ignition chamber, an insulating tubular bushing 41 is engaged with a staged bore, in which a cylindrical electrode 42 is positioned, having three successive stagings 42', 42", 42'" corresponding to the stagings of said bore.

The staging 42' of the electrode 42 which has the smallest diameter, juts out on the outside of the bushing 41, inside an ignition chamber 43.

The staging 42'" of larger diameter, as for it, extends on the outside of the bushing 41 right up to the connection between the tubing 3 and the head 2 of the burner.

In fact, the electrically conducting ignition assembly 40 includes: a first tubular portion 44 with a small passage section, the ignition funnel, one end of which is engaged through the dual grating 24 and on the other side a second tubular portion 45 of larger inner section, closed on the opposite side to the funnel, by the insulating bushing 41 of the electrode 42.

This second tubular portion 45 delimited by the first tubular portion 44 and the bushing in an insulating material 41 equipped with the electrode 42, represents the ignition chamber 43 into which opens out a calibrated orifice 46 provided in the tubular component 45, this calibrated orifice 46 extending radially.

The ignition assembly 40 is in electrical contact with two electrically conducting portions of the head 2 of the burner, via the dual grating 24 on the one hand, and via an electrically conducting holding part 47 on the other hand, which extends radially in the pressure recovery chamber 10.

The head of the burner 2 fits onto the end of the tubing 3 by means of an assembly which provides both a seal and a good electric connection, it being understood that the tubing 3 is electrically connected to the ground of a piezoelectric generator housed in a handle P integral with said tubing 13. Actuation of the piezoelectric generator is provided by means of a trigger G with which the handle P is equipped.

This assembly involves three successive coaxial grooves 48, 49, 50 axially shifted, provided in the fitting area of the tubing 3, two O-ring gaskets 51, 52 in a resilient material, positioned in the first 48 and third groove 50 respectively, and a retaining elastically deformable metal strip 53, the curved end 54 of which is intended to engage into the central groove 49, this metal strip being integral with the head of the burner.

The piezoelectric generator is moreover connected to the ignition electrode 42 by means of an electrically conducting wire 63 and a connector located at the fitting area of the tubing 3.

In this example, this connector involves an insulating collector support 55 appearing as a staged tubular sleeve, in an insulating material, comprising a first staging 56 which fits into the tubing 3 and a second staging 57 with a larger outer diameter which has an inner surface forming an annular groove 58.

In this annular groove, are positioned an electrically conducting washer 59, connected to the electrically conducting wire 63 and being used as an annular electric diffuser on the one hand and a metal coil spring 60 on the other hand, the end of which located towards the outside of the tubing is extended with a radial rectilinear strand 61 which extends diametrically.

The length of the jutting-out portion of the electrode 42 is determined so that, in the assembled position of the head 2 on the tubing 3, the rectilinear strand 61 of the spring 60 engages into a radial groove 62 made in the end of the electrode 42 and remains applied in the bottom of this groove 62 so as to be able to drive the spring 60 into rotation on the electrically conducting washer 59 during rotation of the burner head 2, the assembly thus forming a rotating collector. (Advantageously, the end of the electrode may comprise two radial grooves at 90° from each other).

By means of these arrangements, and in particular by the compression of the spring between the rectilinear strand 61 and the washer 59, excellent electrical contact is obtained between the rectilinear strand 61 and the electrode 42 on the one hand, between the metal washer 59 and the last grinded close turn of the spring 60.

Figure 6:
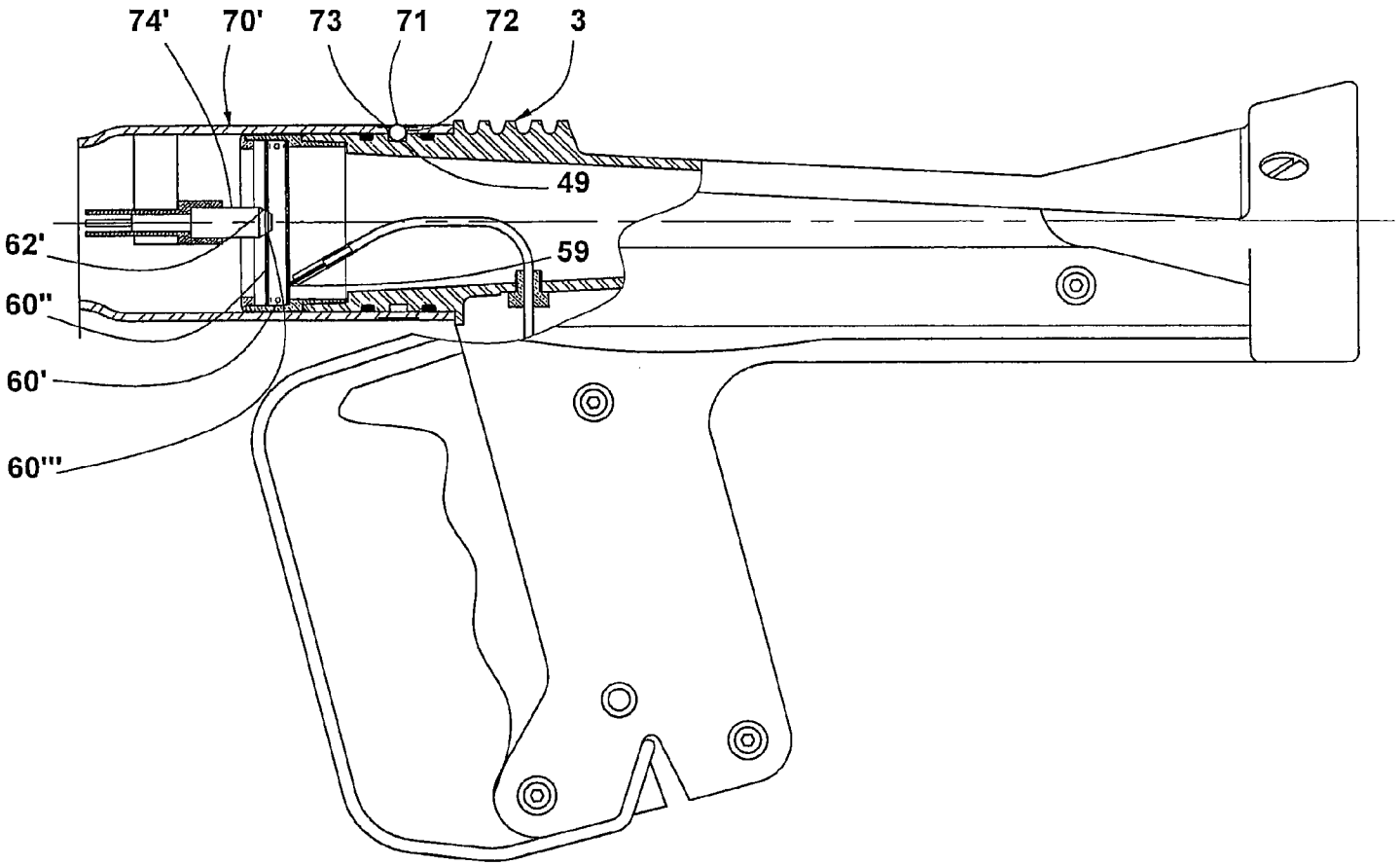
FIG. 6 is a partial sectional view of technical alternatives relating to the snap-on system of the extender and to the connection of the ignition electrode.

An alternative of this design in FIG. 6 consists in replacing the aforesaid spring 60 by the spring 60' and the washer 60" including an axial maneuvering shape 60'" connected to its peripheral portion through one or more connecting arms. This maneuvering shape engages into or around the opposite shape 62' of the electrode 74' in order to be able to drive into rotation the washer 60" on the spring 60' bearing upon the electrically conducting washer 59 upon rotation of the burner head 2, the assembly thus forming a rotating collector.

The hot air generator/burner described earlier may be equipped with a tubular extender 70 which will be inserted between the front end of the tubing 3 and the head 2 of the burner. In this case, in order to avoid backfires upon stopping the burner, a sieve is positioned behind or in place of the grating having an oblong cut-out in the pressure recovery chamber, or between both gratings. This sieve GS comprises a central orifice through which the funnel 44 passes.

Figure 5:
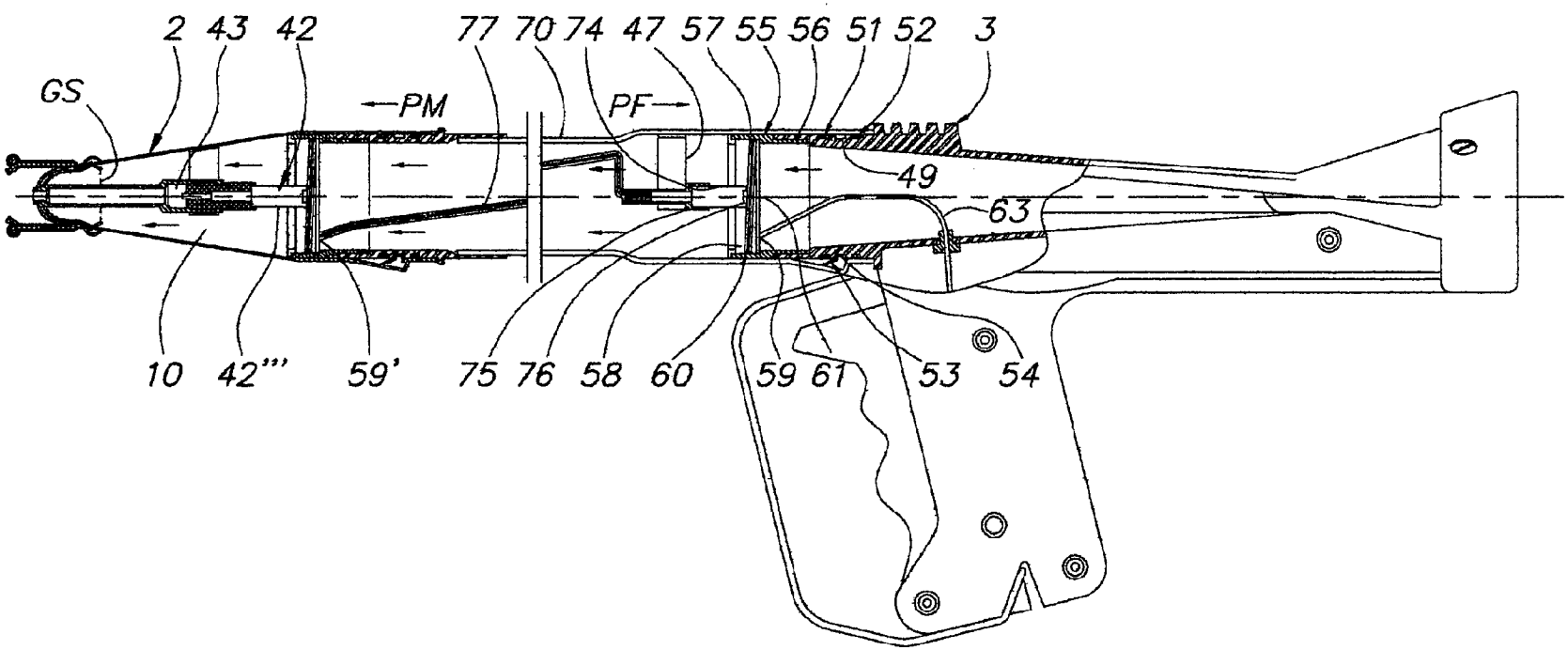
FIG. 5 is a partial sectional view of an alternative embodiment of the burner of FIG. 1 equipped with an extender.

In the example illustrated in FIG. 5, this extender 70 consists in a rigid possibly bent tube having on one side a female assembly profile PF of a type similar to the one used in the head of the burner.

However, in this case, in place of the flexible snap-on strip 53, this female assembly profile may comprise according to FIG. 6, a snap-on mechanism comprising a ball 71 retained inside a conical piercing 72 by an elastic ring 73, so that it may partly engage into the central groove 49 of the end of the tubing 3.

Moreover, in FIG. 5, the extender 70 is provided at this female assembly profile, with a coaxial electrical contact finger 74 mounted on a support in an electrically insulating material 75 attached by means of the support 47 inside the extender 70 at the base of the assembly profile PF.

This electrical contact finger 74 comprises in a way similar to that of the electrode 42, two radial cross-shaped grooves 76 intended to receive the radial rectilinear strand 61 of the spring 60.

The front end of the extender intended to receive the head 2 of the burner has a male assembly profile PM identical with that provided at the end of the tubing 3 and which therefore will not be described again.

The electrical diffusion washer 59' fitting out this male assembly profile PM is then connected to the electrical contact finger 74 via an electrically conducting connecting rod 77. This connecting rod beyond its connection to the washer 59' has a rectilinear section which extends obliquely with respect to the longitudinal axis of the extender. Both ends of this section are symmetrical relatively to a middle point located on said longitudinal axis. The end is connected to the electrical contact finger by means of a portion comprising a substantially radial segment and two bent ends. The advantages of this arrangement have already been described earlier and will therefore not be discussed again.

Optionally the extender may be bent and/or telescopically extensible.

In the latter case, it may be made in at least two tubular sections sliding within each other equipped with means by which temporary axial blocking may be provided and movements of rotation may be limited relatively to each other.

In this case, the connecting conductive wire 77 may be made as a spiral by means of shape memory materials, the diameter of the turns being less than the inner diameter of the extender. With this solution, it is possible to obtain an extensible electrical connection which only perturbs the gas mixture flow circulating in the extender to a very small extent.

Figure 7:
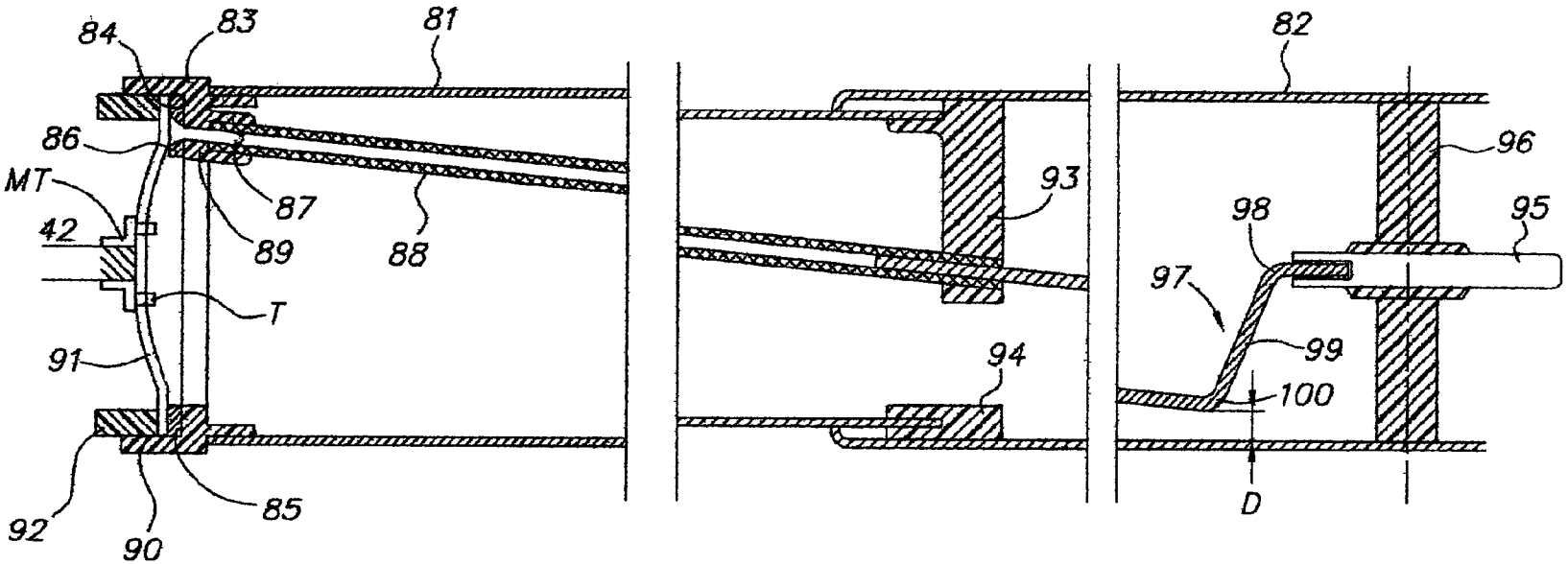
FIG. 7 is a schematic partial sectional view of a telescopic extender.

In the example illustrated in FIG. 7, the extender consists of two cylindrical tubular components 81, 82 of a slightly different diameter, which fit into each other telescopically.

The end of the tubular component 81 opposite to the fitting area comprises a connecting device similar to the one which was described with reference to FIG. 5 and which comprises a tubular sleeve 83 in an electrically insulating material, which partly fits into the component 81. This tubular sleeve 83 has a bore displacement 84 against which an electrically conducting washer 85 provided with a connecting tab 86 protruding inwards is positioned. This connecting tab has a piercing through which passes a fixing screw which will screw into an electrical bushing 87 into which an electrically conducting connecting tube 88 is engaged. This bushing 87 is positioned inside a sheath 89 in an electrically insulating material firmly attached to the sleeve 83 through a spacer.

A rotary connection member comprising an annular component 90 in contact with the washer 85 and a rectilinear component 91 provided with a central embossment which connects two diametrically opposite points of the annular component 90, is held applied against the washer 85.

Maintaining this annular component 90 in contact with the washer 85 is ensured by means of a ring 92 in an electrically insulating material which fits into the tubular sleeve 83.

Figure 4:
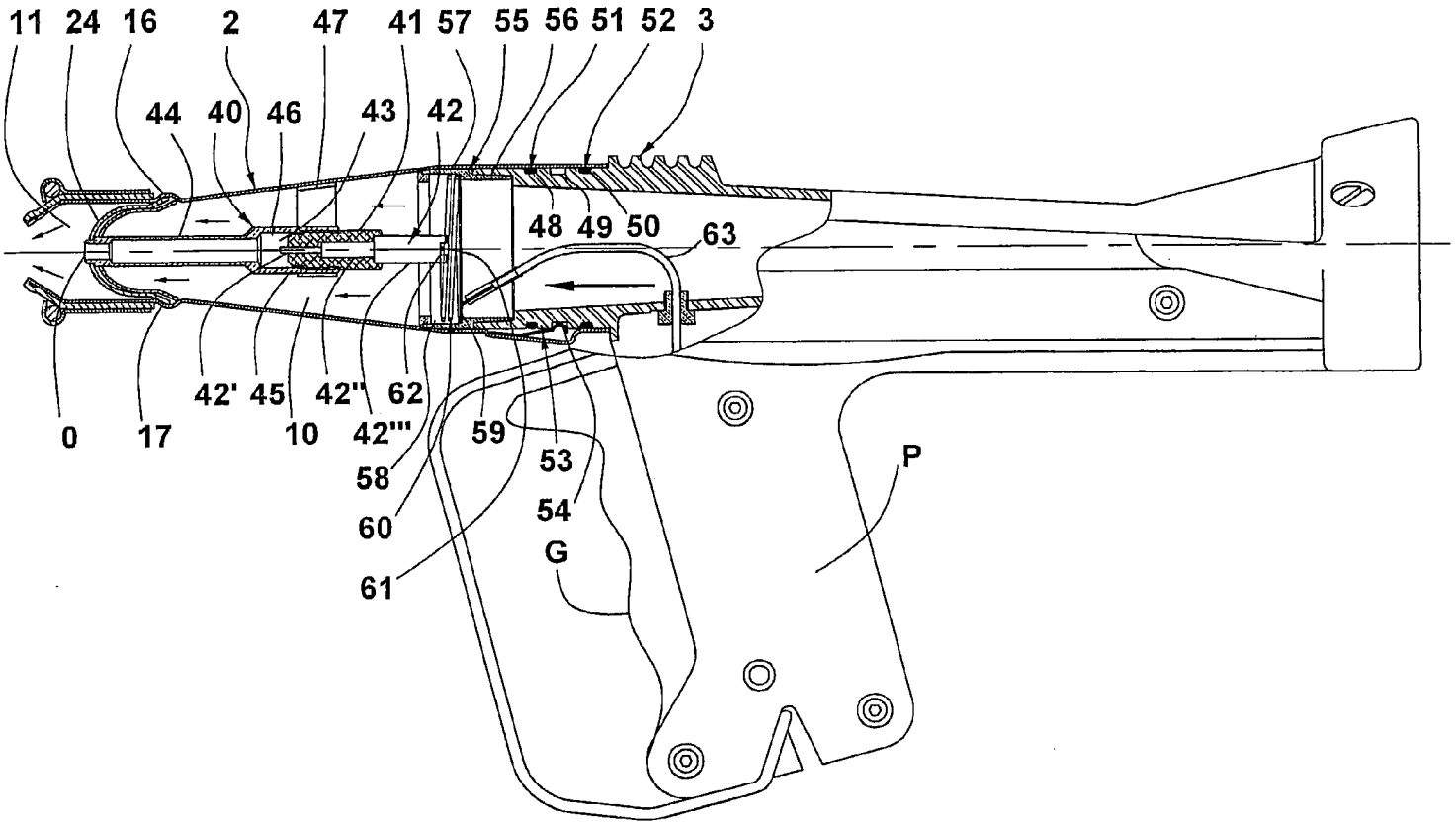
FIG. 4 is a sectional view at a larger scale of the head of the burner illustrated in FIG. 1.

In the same way as the rectilinear strand 61 according to FIG. 5, the rectilinear component 91 is intended to bear upon the front face of the electrode 42 of the head of the burner. Nevertheless, in this case, instead of engaging into the radial groove 62 according to FIG. 4, it engages into spaces comprised between axially protruding nipples provided on the front face of a tubular sleeve MT into which the end of the electrode 42 engages. Advantageously, the sleeve MT may comprise five nipples T uniformly distributed over its circumference.

Inside the tubular component 81, the rectilinear connection tube 88 extends obliquely with respect to the longitudinal axis of the extender.

This tube 88 extends right up to the other end of the component 81. At this end, it is held in position, in the central region of the tubular component 81 by a radial support 93 made in an electrically insulating material firmly attached to an insulating sleeve 94 partly engaged into the component 81.

The end of the tubular component 82 located opposite to the fitting area contains a contact finger 95 similar to the finger 76 described earlier, mounted on a support 96 in an electrically insulating material, and provided with two radial cross-shaped grooves intended to receive the radial rectilinear strand 61 of the spring 60 fitting out the end of the tubing 3. Opposite to the radial groove, the contact finger 95 comprises a cylindrical cavity into which an electrically conducting rod 97 is engaged. This rod 97 comprises, at the outlet of the cavity, a first bend 98 and then a substantially radial portion 99 which extends until it reaches a region located at a determined distance D on the wall of the tubular component 82.

The rod 97 then has a second bend 100 which extends obliquely with respect to the longitudinal axis of the extender, so that it will be introduced into the electric connection tube 88 (the obliqueness of the tube 88 being substantially equal to the obliqueness of the rod 97).

Figure 8:
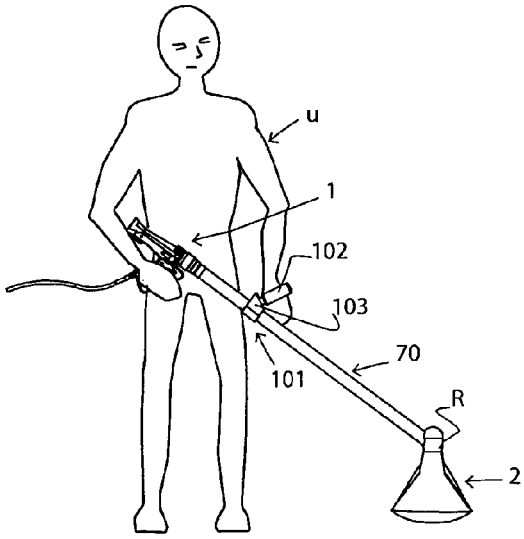
FIGS. 8 and 9 respectively are front and side views of an operator represented by a dummy carrying a hot air generator/burner according to the invention, which may be used for carrying out applications of heat-meltable materials at ground level.
Figure 9:
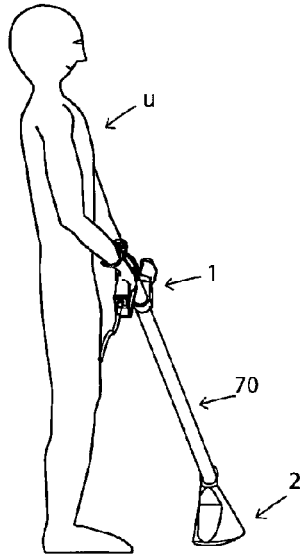
Figure 10:
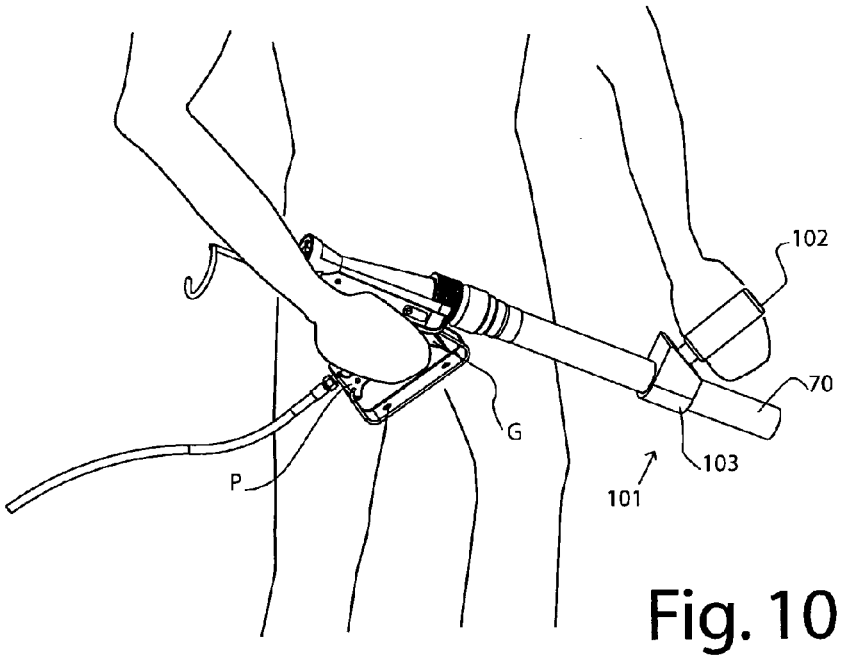
FIG. 10 is an enlarged partial view of FIG. 8.

In the example illustrated in FIGS. 8-10, the device is provided with an extender 70 of great length (much longer than 600 mm), equipped with a suspension means 101 substantially located at the centre of gravity of the device.

In this example, the head 2 of the burner has its axis centered obliquely with respect to the axis of the extender 70, so as to be oriented vertically when the operator U holds the device in the position of use, his/her arms substantially spread along the body. In this position, the extender 70 forms an angle of about 60° relatively to the vertical, an angle which corresponds to the acute angle formed between the axis of the extender 70 and that of the head 2.

The suspension means 101 here consists in a handle 102, jointed to a fixing clamp 103, integral with the extender 70.

By means of these arrangements, the operator U carries the device with his/her left hand (schematically illustrated here by a claw), one arm naturally spread downwards, and this without any effort. The right hand which is engaged with the handle P firmly attached to the injection device 1, is only used for starting/stopping by acting on the trigger G and for sweeping the area to be treated (rotary drive around the vertical axis of the body of the operator). The advantages of this solution have been mentioned earlier. Optionally, the connection R between the extender 70 and the head of the burner 2 may consist in a rotary connection allowing the head 2 to pivot around its longitudinal axis.

Optionally, this connection R may be of the ball joint or Cardan joint type, so as to be able to orient the head 2 in any position. The control for orienting the head 2 may be performed from the handle of the injection device and the suspension device, for example via a flexible <<Bowden>> cable.

Figure 11:
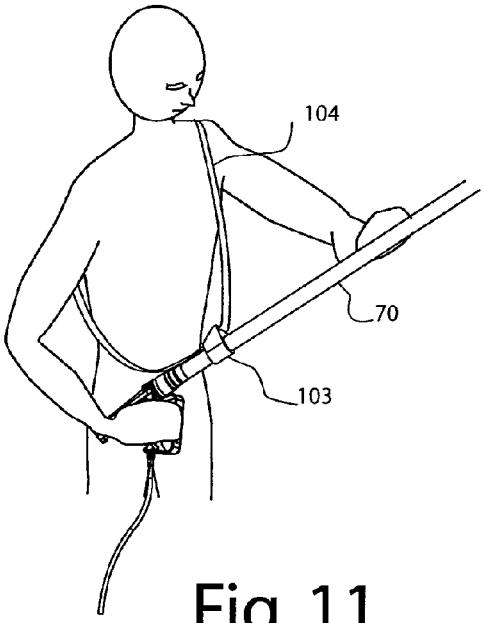
FIG. 11 is a partial view of a dummy carrying a hot air generator/burner, via a harness.

Advantageously, the clamp 103 may be equipped with a means for hanging a harness 104, which may be used additionally or as a replacement for the handle 102. In the example illustrated in FIG. 11, this harness 104 is reduced to a simple strap forming a loop. With this solution, it is possible to considerably reduce the strain on the operator while increasing the accuracy of the treatment.

In the case when the device has to be handled at arm's length, for example in order to reach remote treatment areas, the invention provides the use of a holding device 105 supported on the forearm of the operator when the latter holds the device with the handle P. This holding device 105 which is removably attached on the injection device 1 (at the jet pump) may consist in a loop 106 formed by:

- a strap in a flexible material (fabric, leather, plastic),
- a ring which may be open and adjusted (for example by means of a mechanism of the belt buckle type, strap clamp, self-grip strap by means of a hook and loop fastener (registered trade mark <<Velcro>>).

Figure 12:
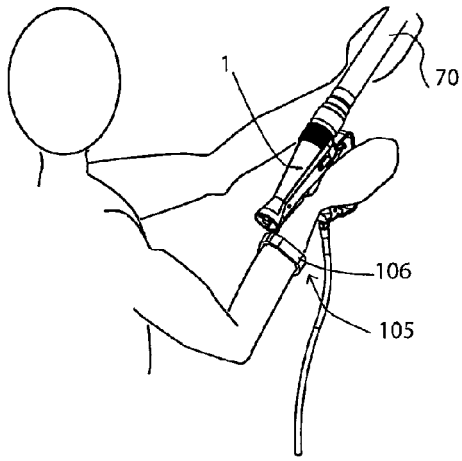
FIG. 12 is a partial view of a dummy carrying a hot air generator/burner equipped with a first type of holding device.

The advantage of this solution which is illustrated in FIG. 12 consists in that the holding device 105, which is adjusted and easily adapted to the morphology of each individual, performs a partial transfer of the load (weight of the device) to the forearm of the operator, while leaving his/her wrist free.

Because of its flexibility, it is not a nuisance, when the device is not in use, and does not require its systematic removal after use.

Figure 13:
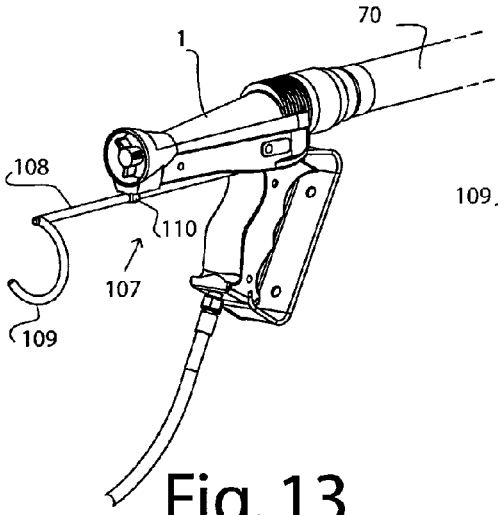
FIGS. 13 and 14 are perspective views of a hot air generator/burner equipped with a second type of holding device.
Figure 14:
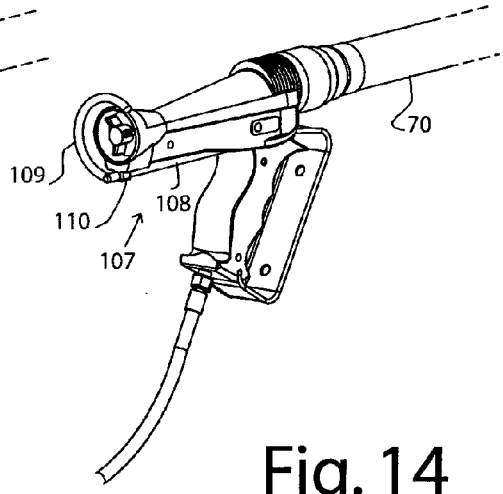

In the example illustrated in FIGS. 13 and 14, the holding device 107 is formed by a rod having a rectilinear portion 108, extending on one side with a bent portion 109 which extends in a plane perpendicular to the axis of the rectilinear portion 108.

The rectilinear portion 108 engages into a sliding bearing 110, provided on the injection device 1 and with an axis parallel to the latter. This sliding bearing 110 is moreover equipped with a device for axially and rotatably blocking the rod 108, 109.

By means of these arrangements, the rod 108, 109 may assume:

- a position spread out towards the rear (position of use) in which the bent portion 109 may come and partly encircle the forearm of the operator in order to provide its holding function, in FIG. 13, and,
- a retracted position in which the bent portion 109 is positioned against the injection device, substantially coaxially with the latter. In this position, the holding device 107 does not cause any bother to the operator, both when it is not in use and during a use in which the holding device is not required.

Of course, the arrangements described earlier may be combined with each other. Thus, the device may comprise both an extender device 101, such as those illustrated in FIGS. 8-11 and a holding device 105, 107 such as those illustrated in FIGS. 12-14. With this combination, it is actually possible to increase the ergonomics of the device and thereby obtain better accuracy.

The invention claimed is:

1. A hot air generator device comprising an injection device capable of producing a flow of combustible gas mixture at high velocity, said injection device including tubing comprising a convergent back section, a divergent front section, an injection nozzle mounted in the convergent section and connected to a source of pressurized gas, an opening for letting through air located in an annular area comprised between said nozzle and said back section, and a first handle mounted on said tubing and a burner head, in which said flow is injected via a tubular extender connecting said injection device to said head, said device further comprising an extractable and/or retractable holding device, mounted on the injection device, said holding device being intended to be supported on the forearm of the operator when the latter holds the device with the first handle with which the injection device is equipped, the holding device being formed by a rod having a rectilinear portion, extending on one side with a bent portion in a plane perpendicular to the axis of the rectilinear portion and wherein the rectilinear portion engages into a sliding bearing provided on the injection device and with an axis parallel to the latter, said sliding bearing being equipped with a device for axially and rotatably blocking the rod.

2. The device according to claim 1, wherein the axis of the head of the burner is oblique relatively to the axis of the extender.

3. The device according to claim 1, further comprising a connection with adjustable orientation between the extender and the head of the burner.

4. The device according to claim 3, further comprising means for controlling the orientation of the head of the burner from the injection device or the suspension device.

5. The device according to claim 1, wherein the holding device comprises a loop formed by a strap in a flexible material or by a ring which may be opened and adjusted.

6. The device according to claim 1, further comprising a second handle having an annular shape.

7. A hot air generator device comprising an injection device capable of producing a flow of combustible gas mixture at high velocity, said injection device including tubing comprising a convergent back section and a divergent front section, an injection nozzle mounted in the convergent back section and connected to a source of pressurized gas, an opening for letting through air located in an annular area defined between said nozzle and said convergent back section, a handle mounted on said tubing, a burner head, in which said flow is injected via a tubular extender connecting said injection device to said head, and an extractable and/or retractable holding device, mounted on the injection device at the convergent back section, said holding device comprising a rod and a bent portion connected to said rod extending in a plane perpendicular to a longitudinal axis of said rod, said holding device being supported on the forearm of the operator by the bent portion when the operator holds the device with the handle with which the injection device is equipped, said rod being connected to said injection device so as to be moveable between an extended position in which the bent portion is spaced from said convergent back section and can be placed on the forearm of the operator and a retracted position in which the bent portion is positioned substantially coaxially and against the injection device, such that the bent portion does not hinder use of the device regardless of whether said rod is in either the retracted or extended position.

8. The device according to claim 7, wherein the bent portion of the holding device comprises a ring which may be opened and adjusted.

9. The device according to claim 7, wherein the rod engages into a sliding bearing provided on the injection device, said sliding bearing being equipped with a device for axially and rotatably blocking the rod.

* * * * *